US005790095A

United States Patent [19]

Onodera et al.

[11] Patent Number: 5,790,095

[45] Date of Patent: Aug. 4, 1998

[54] ERROR VARIANCE PROCESSING EQUIPMENT FOR DISPLAY DEVICE

[75] Inventors: Junichi Onodera; Masamichi Nakajima; Asao Kosakai; Masayuki Kobayashi; Hayato Denda; Seiji Matsunaga, all of Kanagawa-ken, Japan

[73] Assignee: Fujitsu General Limited, Kanagawa-ken, Japan

[21] Appl. No.: 539,238

[22] Filed: Oct. 4, 1995

[30] Foreign Application Priority Data

| | | | |
|---|---|---|---|
| Oct. 6, 1994 | [JP] | Japan | 6-268336 |
| Jan. 6, 1995 | [JP] | Japan | 7-016566 |
| Jan. 6, 1995 | [JP] | Japan | 7-016567 |

[51] Int. Cl.[6] ..... G09G 5/10

[52] U.S. Cl. ..... 345/147; 382/252

[58] Field of Search ..... 345/20, 63, 77, 345/147, 155, 207; 382/252, 274, 251

[56] References Cited

U.S. PATENT DOCUMENTS

| | | | |
|---|---|---|---|
| 4,349,819 | 9/1982 | Terakawa | 345/63 |
| 5,351,315 | 9/1994 | Ueda et al. | 345/136 |
| 5,596,349 | 1/1997 | Kobayashi et al. | 345/147 |

FOREIGN PATENT DOCUMENTS

| | | |
|---|---|---|
| 264302 | 4/1988 | European Pat. Off. . |
| 488891 | 6/1992 | European Pat. Off. . |
| 653740 | 5/1995 | European Pat. Off. . |

*Primary Examiner*—Steven J. Saras
*Assistant Examiner*—Xu-Ming Wu
*Attorney, Agent, or Firm*—McDermott, Will & Emery

[57] ABSTRACT

Coupled to an error variance circuit 11 is an emission luminance characteristic acquisition circuit 20 that counts up, at a display number counter 21, the display number in the single or plural frames of the respective bits of image data by the counters, M in number, corresponding to said bits, then solves for display area percentage (Sk) dividing, at a display area percentage operation part 22, the display dot number as counted at a display number counter 21, by total dot number, and acquires the luminance deviation characteristic for each bit by means of an emission luminance deviation characteristic measuring part 24. The luminance deviation thus obtained is renewed for each frame and transferred to the error variance circuit 11, and processed for error variance on the basis of the emission luminance characteristic to be output at PDP. At low level, on the other hand, the luminance deviation is rendered either fixed type luminance deviation or emission luminance level more or less higher than the actual one to reduce the diffusion noise particularly at the low level image portion thereby obtaining a more natural image.

18 Claims, 11 Drawing Sheets

ERROR VARIANCE PROCESSING EQUIPMENT FOR DISPLAY DEVICE

BACKGROUND OF THE INVENTION (1) Field of the Invention

This invention relates to that error variance processing equipment for display device which displays false half tone by error variance.

(2) Description of the Prior Art

Recently PDP (Plasma Display Panel) has been attracting a good deal of public attention as a thin, light-weighted display device. Totally different from the conventional CRT drive, the drive method of this PDP is a direct drive by means of digitalized image input signal. Consequently, the luminance and tone of the light emitted from the panel face depends on the bit number of the signal to be processed.

PDP may be divided into two types: Ac and DC types whose basic characteristics are different from each other.

AC type PDP features satisfactory characteristics as far as is concerned the luminance and durability. As for the tonal display, maximum 64 tones only have reportedly been displayed at the level of trial production. It is however proposed to adopt in future a technique for 256 tones by address/display separate type drive method (ADS subfield method).

One frame consists of 8 subfields whose relative ratios of luminance are 1, 2, 4, 8, 16, 32, 64 and 128 respectively. Combination of these 8 luminances enables a display in 256 tones. The respective subfields are composed of the address duration that writes in one screen of refreshed data and the sustaining duration that decides the luminance level of the corresponding fields. In the address duration, first wall charge is formed initially at each pixel simultaneously over all the screens, and then the sustaining pulse is given to all the screens for display. The brightness of the subfield is proportional to the number of the sustaining pulse to be set to predetermined luminance. Two hundred and fifty-six tonal display is thus realized.

In such an AC drive method, the more the number of tones, the more the number of bits of the address duration as the preparation time for lighting up and making the panel luminescent within one frame of duration increases. The sustaining duration as light emitting duration becomes therefore relatively short reducing thus the maximum luminance.

Because the luminance and tone of the light emitted from the panel face depends upon the number of bits of the signal to be processed, increased number of the bits of the signal improves the picture quality, but decreases the emission luminance. If conversely the number of the bits of the signal to be processed is decreased, the emission luminance increases but decreases the tone to de displayed thereby causing the degradation of the picture quality.

The error variance intended to minimize the color depth difference between the input signal and emission luminance rendering the number of bits of the output drive signal smaller than that of the input signal is a process to express false half tone used when the maximal shade of color is desired to be manifested with lesser tone.

FIG. 1 shows a conventional, general error variance circuit, where an image signal with the original picture elements or pixels Ai, j of p (8, for example) bits is input into the error variance circuit 11 from an image signal input terminal 10. This image signal is processed in a processing circuit 13 and reduced to q (4, for example) in bit number before emitting light from PDP.

On the other hand, an emission luminance characteristic operation part 14 consisting of ROM and other components measures and stores the emission luminance characteristic of the PDP from, for instance, the representative input data (solid line) as far approximate as possible to the equation y=x (dotted line) shown in FIG. 2. The emission luminance characteristic is sent to the error operation part 12 to calculate out the error, which is added to the input image signal in a processing circuit 13 where it is diffused. False half tone was thus displayed.

As a result, a corrected luminance line as y=x (dotted line) was obtained despite the instantaneous emission luminance in steplike form (solid line), which in fact was recognized as smoothed-out shape.

The emission luminance characteristic of such a display device as PDP varies however in terms of the data to be displayed, sometimes resulting in that emission luminance characteristic largely slanting from the y=x (dotted line) which is shown by the solid line in FIG. 3. The prior art was problematical in that the method of convergence into representative emission luminance characteristic as shown in FIG. 2 was not well applicable to any tonal characteristic of the data other than that when such a representative characteristic was acquired, thereby eliciting the false contour caused by the tonal inadequacy.

BRIEF SUMMARY OF THE INVENTION

It is the primary object of this invention to prevent the false contour apt to appear when an error is dispersed on the basis of a representative luminance deviation characteristic.

To achieve this principal object the present invention allows to calculate the emission luminance characteristic for every single or plural frames on the basis of the luminance deviation characteristic as obtained from the load factor of the input data of a display device like PDP instead of the conventional emission luminance characteristic that was given from ROM, dispersing the error by renewal of the emission luminance characteristic for every single or plural frames to prevent the appearance of the false contour. Attaining this primary object of the present invention will permit to renew the tonal characteristic in response to the emission luminance characteristic that may vary in terms of the data to be displayed as shown by solid, dotted, and chain lines in FIG. 4. Since the conventional convergence into representative emission luminance characteristic is thus avoided, the error variance can adapt itself well to the tonal characteristic of any data which may change moment by moment.

Although such a renewal of tonal characteristic for every single or plural frames may enhance the tonal linearity, it encounters a problem that the diffusion noise stands out visually to a pronounced degree particularly at low level of image. That is, since at low level of image, the image as a whole is dark to an extent of black level, even tiny white dots of diffusion pattern are conspicuous visually.

It is the second object of this invention to improve the performance of the first object mentioned above. Namely, the emission luminance characteristic for every single or plural frames is calculated out on the basis of the luminance deviation characteristic as obtained from the load factor of the input data of the display device. The characteristic thus calculated is then renewed to diffuse the error thereby keeping the false contour from appearing. In an equipment intended for such an error variance, the diffusion noise does not stand out prominent in particular at low level of image.

Other and further objects of this invention will become obvious upon an understanding of the illustrative embodiments about to be described.

DETAILED DESCRIPTION

Referring now in particular to the drawings, there are illustrated the embodiments of this invention. This invention will be understood more readily with reference to the following examples; however these examples are intended to illustrate the intention and are not to be construed to limit the scope of this invention.

In an exemplary PDP used as a display device that is driven by the aforesaid address/display separate type driving method (ADS subfield method), the display tone number N enabled by the ADS subfield is determined by M, the number of subfields; $N=2^M$.

An ideal luminance level Yn of a given input level n may be expressed by:

$$Yn = \sum_{k=0}^{k=M-1} b_k \times 2^k \alpha \quad (\alpha\text{: the referential emission luminance level})$$

where n is binary converted, the respective bits are $b_{N-1}, \ldots b_2, b_1$ and $b_0$.

Since in fact there exists a luminance deviation that depends upon the display area percentage (Sk) for every subframe, $$Yn = \sum_{k=0}^{k=M-1} b_k \times 2^k \times (\alpha + \delta(Sk))$$

where δ represents the emission luminance deviation characteristic as obtained from the load factor of input data, and $$\text{Display area percentage}(Sk) = \frac{\text{Display dot number of the subfield } K}{\text{Dot number on the screen}}$$

Figure 5:
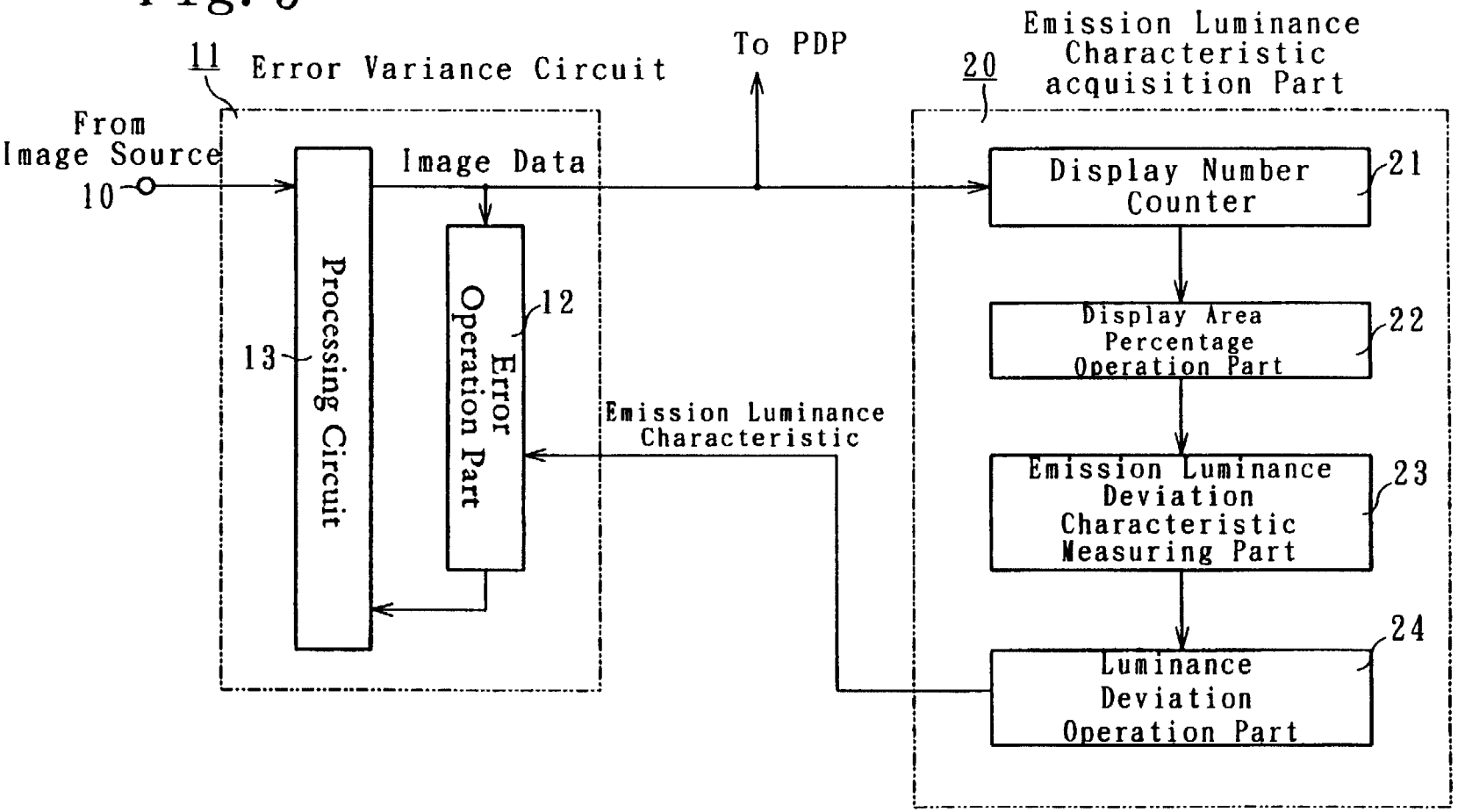
FIG. 5 is a block diagram that shows up the first embodiment of the error variance processing equipment for display device according to this invention.

First Embodiment:

FIG. 5 represents the first embodiment of this invention, which consists of the conventional error variance circuit 11 and the emission luminance characteristic acquisition circuit 20.

Figure 1:
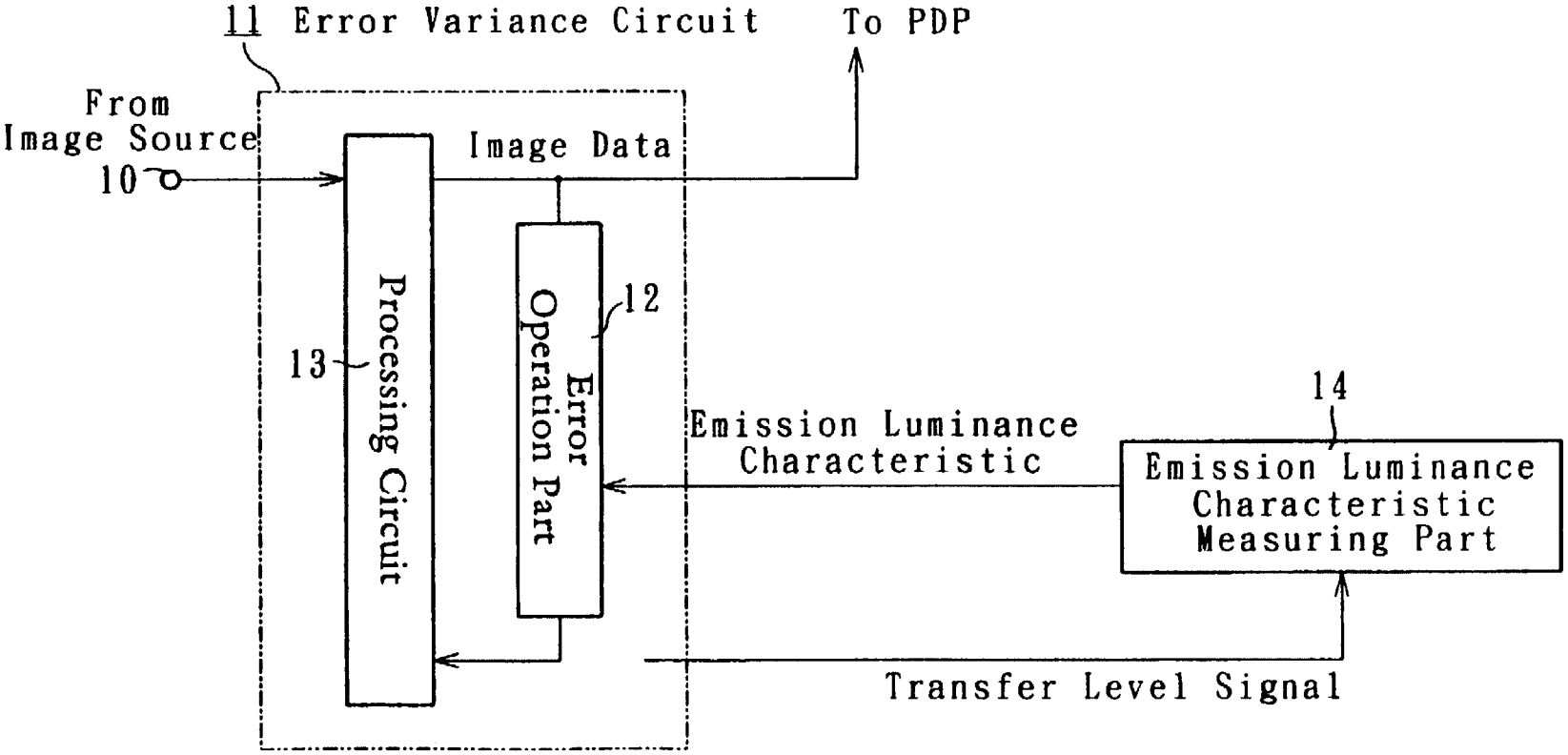
Fig. 1 PRIOR ART
FIG. 1 is a block diagram of a conventional error variance circuit.
Figure 2:
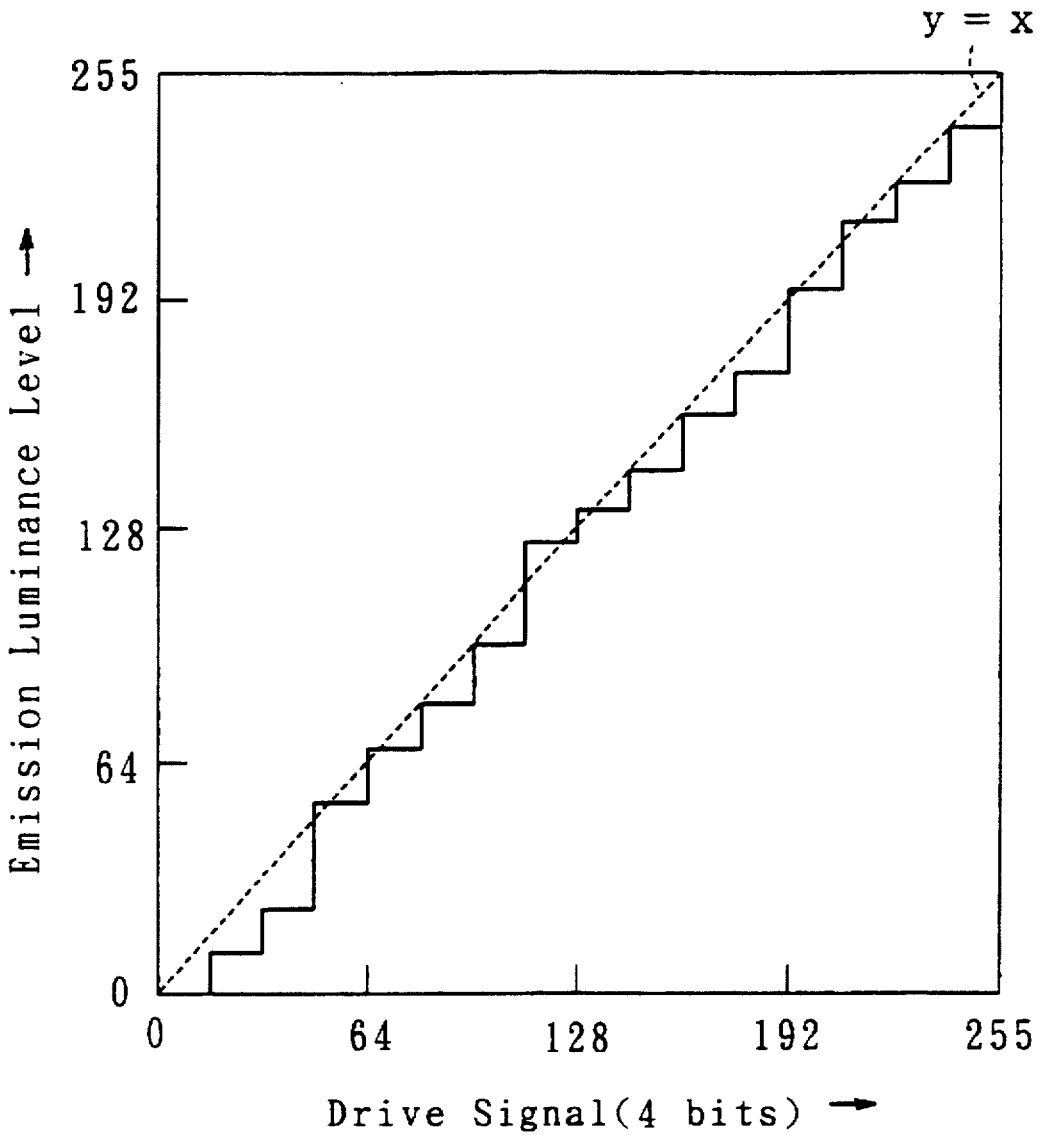
Fig. 2 PRIOR ART
FIG. 2 is a characteristic diagram that illustrates a representative example of emission luminance characteristic.
Figure 3:
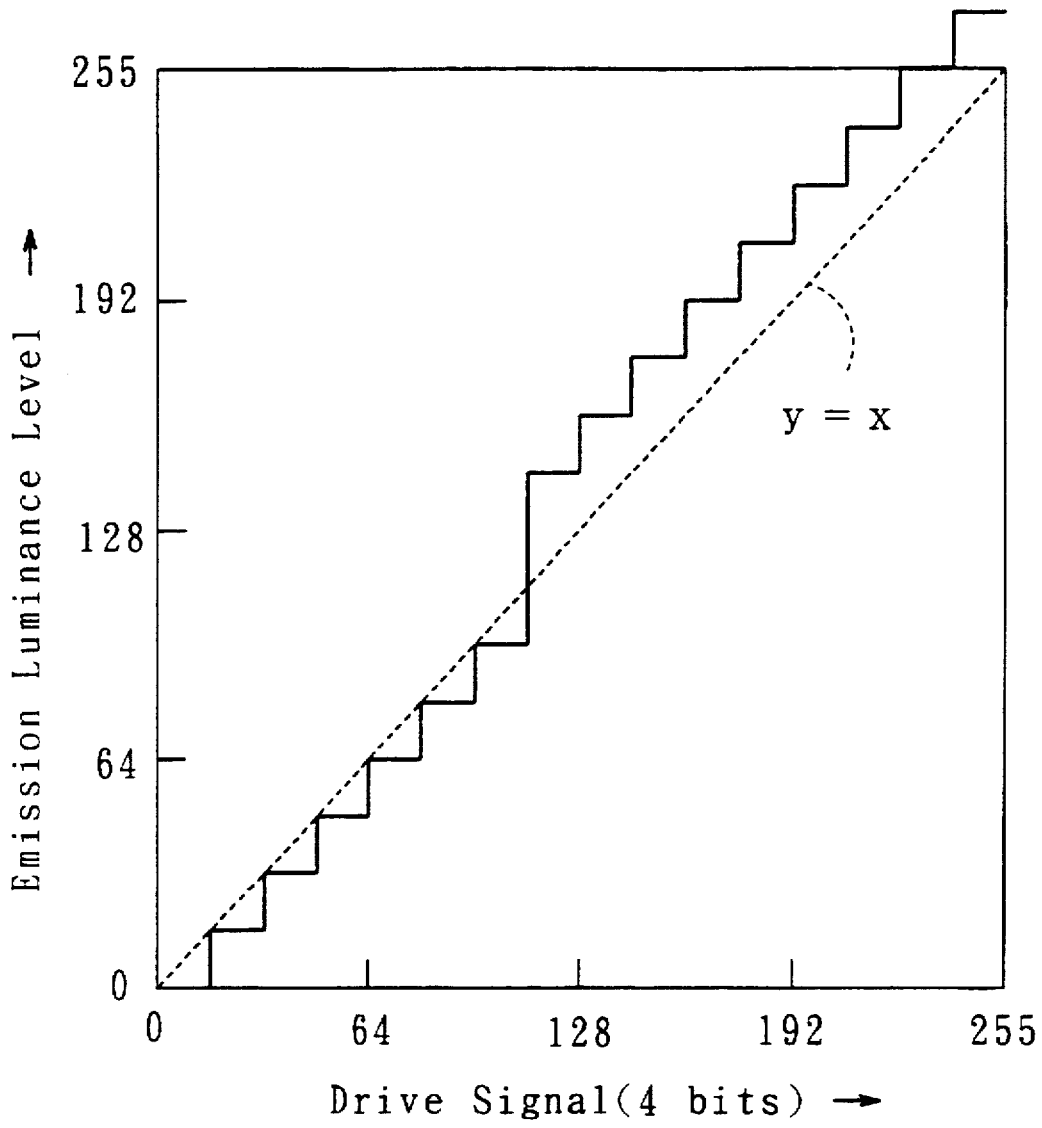
FIG. 3 is another characteristic diagram that illustrates another example of emission luminance characteristic.

As has been already explained referring to FIG. 1, the conventional error variance circuit 11 consisting of error operation part 12 and processing part 13 performs the error variance on the basis of given emission luminance characteristic to display the false half tone.

Referring now to FIG. 5, the emission luminance characteristic acquisition circuit 20 by this invention, which consists of the display number counter 21, the display area percentage operation part 22, emission luminance deviation characteristic measuring part 23, and the luminance deviation operation part 24, acquires the emission luminance characteristic for every single or plural frames from the image data driven by PDP, and transfers the emission luminance characteristic thus obtained to the error variance circuit 11 during the vertical synchronization of the image.

More specifically, the display number counter 21 consisting of M counters counts up the display number of the in single or plural frames using the respective counters corresponding to the respective M bits of the image data. The display area percentage operation part 22 gives the display area percentage (Sk) dividing, by "total dot number," the "display dot number of subfield K" as counted at the display number counter 21.

The emission luminance deviation characteristic measuring part 23, which consists of such LUT (lookup table) as ROM seeks after the luminance deviation characteristic of respective bits.

The luminance deviation operation part 24 solves for the luminance deviation at each level.

The operation of the above described mechanism and further constructional features and advantages will be best appreciated from a description of a complete cycle of operation.

The display number counter 21 counts up the "display dot number of subfield K," that is, the display number in single or plural frames of respective bits by M counters corresponding to the respective M bits of image data.

The display area percentage operation part 22 gives the display area percentage (Sk) dividing, by "total dot number," the "display dot number of subfield K" as counted at the display number counter 21.

The emission luminance deviation characteristic measuring part 23 gives the luminance deviation characteristic of each bit, based on which the luminance deviation operation part 24 solves for the luminance deviation at each level.

Figure 6:
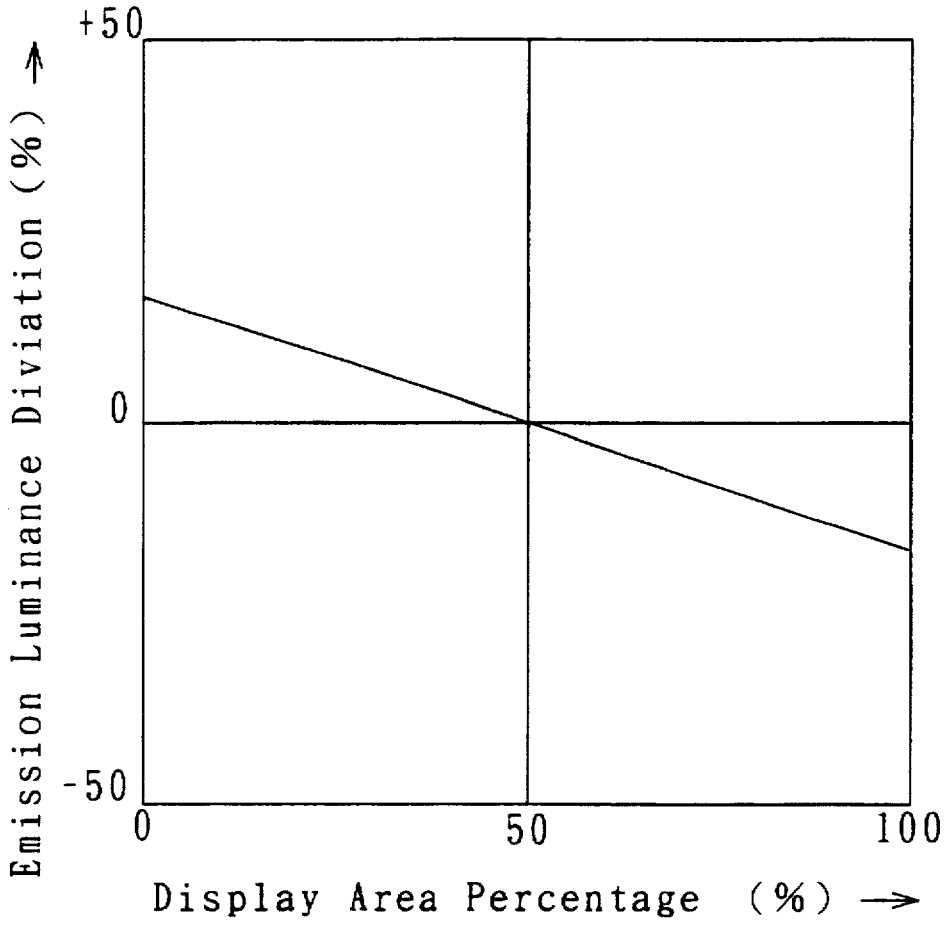
FIG. 6 is a characteristic diagram that depicts the relationship between the emission luminance deviation and display area percentage.

The emission luminance characteristic acquisition circuit 20 calculates the emission luminance level Yn at a given input level n as $$Yn = \sum_{k=0}^{k=M-1} b_k \times 2^k \times (\alpha + \delta(Sk))$$

taking into consideration the luminance deviation that depends on the display area percentage (Sk) of each subframe, where the luminance deviation characteristic (δ) obtained from the load factor of input data gives in general such characteristic line as shown in FIG. 6. The function to solve for this δ has been stored in the emission luminance deviation characteristic measuring part 23.

The luminance deviation at each level can be calculated by the following equation:

$$\Delta n = \sum_{k=0}^{k=M-1} b_k \times 2^k \times \delta(Sk)$$

The deviation is renewed for every single or plural frames to be transferred to the error variance circuit 11, where error is diffused on the basis of the emission luminance characteristic to be output at the PDP.

Since the convergence into representative emission luminance characteristic is thus avoided by this configuration, the error variance can adapt itself well to the tonal characteristic of any data which may change moment by moment contribute to the prevention of the noise at low level.

Figure 7:
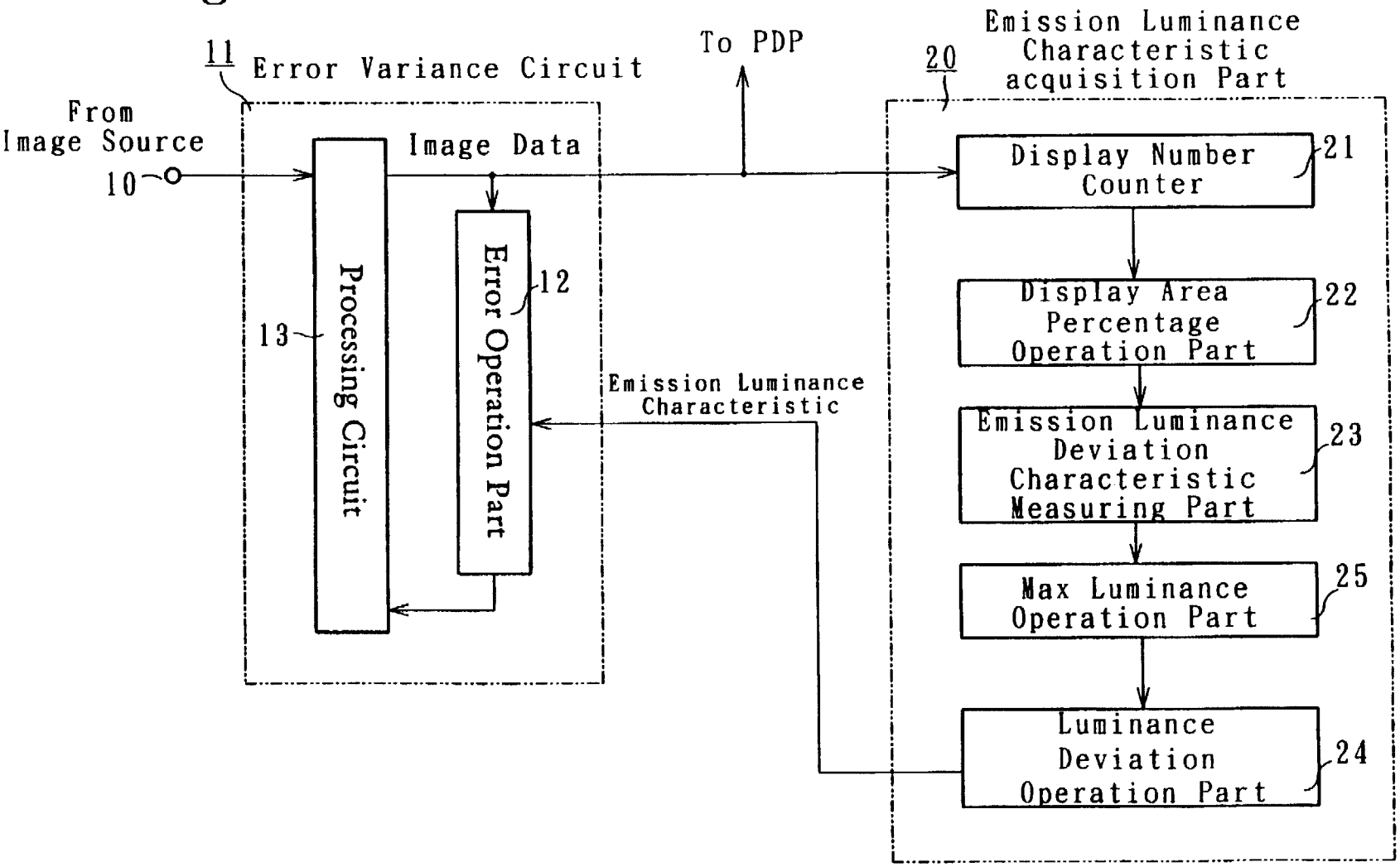
FIG. 7 is a block diagram that shows up the second embodiment of the error variance processing equipment for display device according to this invention.

Second Embodiment:

The second embodiment of this invention will be explained referring to FIG. 7.

It differs from the first embodiment of this invention in that the maximum luminance operation part 25 has been inserted between the emission luminance deviation characteristic measuring part 23 and the luminance deviation operation part 24.

Consequently the display number counter 21 counts up the "display dot number of subfield K," which is the display number in a single or plural frames of respective bits by means of M counters corresponding to the respective bits of M bit image data.

The display area percentage operation part 22 gives the display area percentage (Sk) dividing, by "total dot number," the "display dot number of subfield K" as counted at the display number counter 21.

The operation up to the emission luminance deviation characteristic measuring part 23, namely up to the stage where the luminance deviation characteristic of each bit is given by the emission luminance deviation characteristic measuring part 23 is the same as in the first embodiment.

Next, in the second embodiment, the maximum luminance operation part 25 calculates the luminance at the maximum input level.

Figure 8:
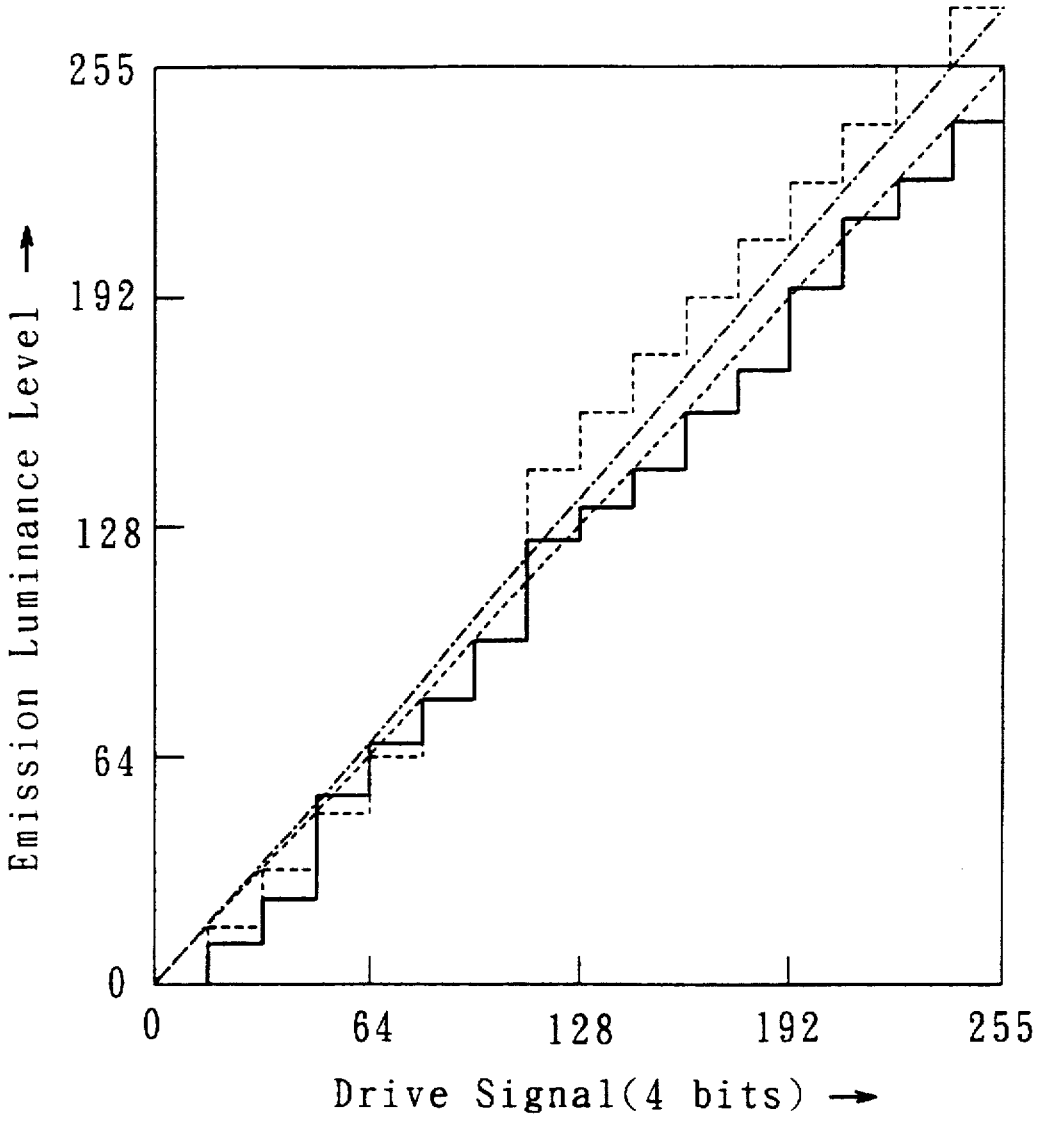
FIG. 8 is another characteristic diagram that illustrates another example of emission luminance characteristic.

That is, in the case of such emission luminance characteristic as shown by the dotted lines in FIG. 8, the maximum luminance operation part 25 computes by the following formula:

$$Ymax = \sum_{k=0}^{k=M-1} 2^k \times (\alpha + \delta(Sk))$$

where $max=2^{M-1}$.

Based upon this data, the luminance deviation operation part 24 calculates the luminance deviation of each level by the following equation:

$$\Delta n = Yn - \frac{n}{2^M} Ymax$$

The luminance deviation of each level as obtained by this luminance deviation operation part 24 is transferred to the error operation part 12 of the error variance circuit 11.

When the luminance at the maximum input level breaks away from the line y=x, overall correction is applied so that the maximum input level should come nearer to the line y=x. As a result, the characteristic as represented by the dotted lines in FIG. 8 is converted into that expressed by the solid lines.

Then the error operation part 12 and the processing circuit 13 perform the processing of error variance based on given emission luminance characteristic to display the false half tone.

The first and second embodiments of this invention have the following actions and effects.

(1) According to this invention, the emission luminance characteristic for every single or plural frames is computed on the basis of the luminance deviation characteristic as obtained from the load factor of input data instead of the conventional representative emission luminance characteristic as given from ROM, when the emission luminance deviation characteristic is changed by the data to be displayed. Since further the emission luminance characteristic is renewed for every single or plural frames to diffuse the error, the false contour can be kept from appearing.

(2) Because the maximum luminance operation part 25 is provided for total correction so that the maximum input level should come nearer to the line y=x when the luminance at the maximum input level deviates from y=x, the error variance can be performed more exactly to prevent the appearance of the false contour.

(3) Because this invention uses the low order bits (n-m=4) after variance when variance processing is made by adding reproduced error to the image signal with original pixels of n (for example, 8) bits by the vertical adder 31 and horizontal adder 32, this can be identified as the use of a luminance correction line connecting the starting points of the emission luminance levels of 2 m tones. In consequence the image after the error variance manifests a smooth change.

Figure 9:
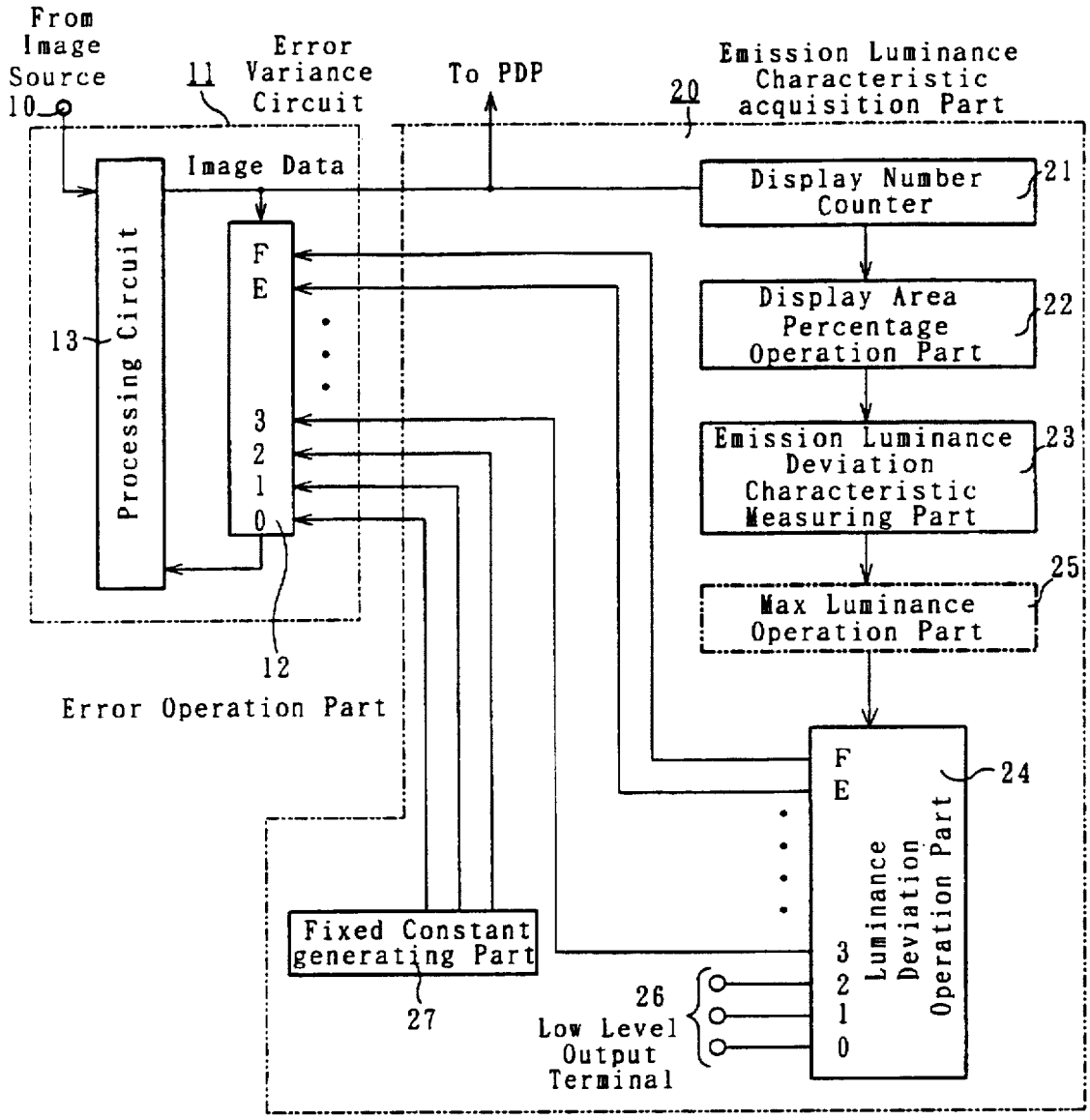
FIG. 9 is a block diagram that shows up the third embodiment of the error variance processing equipment for display device according to this invention.
Figure 10:
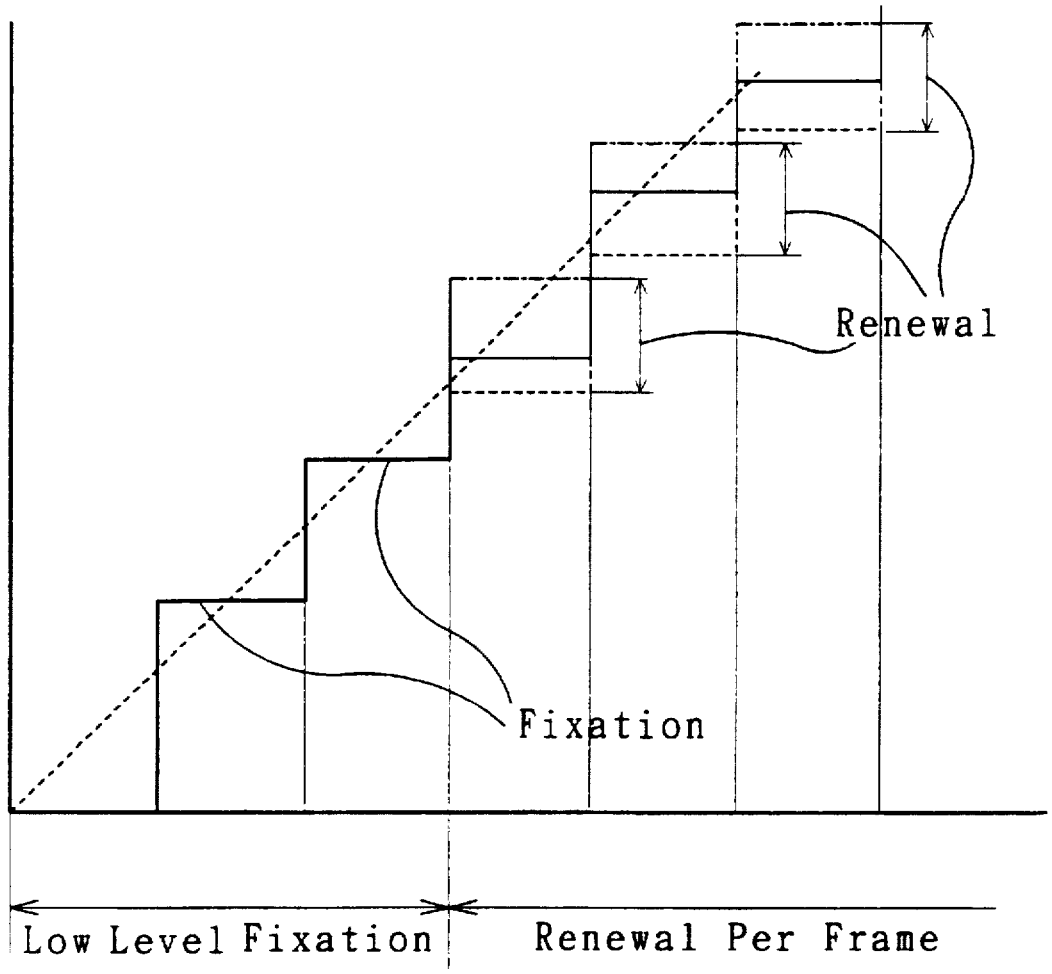
FIG. 10 is a characteristic diagram that illustrates an example of emission luminance characteristic by the third embodiment of this invention.

Third Embodiment:

Referring now to FIG. 9, the equipment according to this invention consists of the error variance circuit 11 and the emission luminance characteristic acquisition circuit 20.

The emission luminance characteristic acquisition circuit 20 comprising the display number counter 21, the display area percentage operation part 22, the emission luminance deviation characteristic measuring part 23, and the luminance deviation operation part 24, is intended to acquire the emission luminance characteristic for every single or plural frames from the image data driven by the PDP and transfers the luminance characteristic to the error variance circuit 11 during the vertical synchronization of the image. More specifically in the third embodiment of this invention the low level output terminal 26 of the luminance deviation operation part 24 is not connected to the error operation part 12, but a fixed constant generating part 27 is connected to the low level input of the error operation part 12 to fix the data into the representative input data as near as possible to the preset y=x.

More particularly, the display area percentage operation part 22, the emission luminance deviation characteristic measuring part 23 are like those in the first embodiment. The luminance deviation operation part 24 is intended to solve for the luminance deviation at each level for renewing the tonal characteristic of the data other than the low level data for every single or plural frames.

The actions and effects are now described of the constructional configuration as above.

The third embodiment is identical with the first one in that the luminance deviation at each level in the emission luminance characteristic acquisition circuit 20 is renewed for each single or plural frames and that those at levels other than the low level are transferred to the error variance circuit 11.

In the third embodiment of this invention the preset data, particularly at levels other than low level is transferred from fixed constant generating part 27 to the error variance circuit 11.

The error variance circuit 11 processes the error variance based on the luminance deviation at the levels other than the low level renewed momentarily by the luminance deviation operation part 24 and on the emission luminance characteristic of the fixed type data for low level preset from the fixed constant generating part 27 to output it to the PDP.

The configuration as above can cope perfectly with the tonal characteristic of the ever changing data preventing thus the generation of the low level noise caused by changeover of the luminance deviation, because the convergence is not made into representative emission luminance characteristic even if this characteristic varies with the data to be displayed.

The actions and effects of the insertion of the maximum luminance operation part 25 between the emission luminance deviation characteristic measuring part 23 and the luminance deviation operation part 24 in this third embodiment are the same as in the second embodiment.

As for the low level, the preset data is transferred from the fixed constant generating part 27 to the error variance circuit 11 in this case too.

The error variance circuit 11 processes the error variance to output its luminance characteristics on the basis of the emission luminance characteristic of the luminance deviation at the levels other than the low level momentarily renewed by the luminance deviation operation part 24 and that of the fixed type luminance deviation preset by the fixed constant generating part 27.

The configuration as above can cope perfectly with the tonal characteristic of the ever changing data preventing thus the generation of the low level noise caused by changeover of luminance deviation, because the convergence is not made into representative emission luminance characteristic even if this characteristic varies with the data to be displayed.

The third embodiment of this invention has the following actions and effects.

Because this invention allows to perform the error variance by calculating the emission luminance characteristic for every single or plural frames at the levels other than the low one based on the luminance deviation characteristic as got from the load factor of input data and renewing the emission luminance characteristic for every single or plural frames, the false contours can be kept from appearing. Since at the same time the fixed type data is used at low level the noise by changeover of luminance deviation at low level caused by the calculation for every single or plural frames may be avoided.

Figure 11:
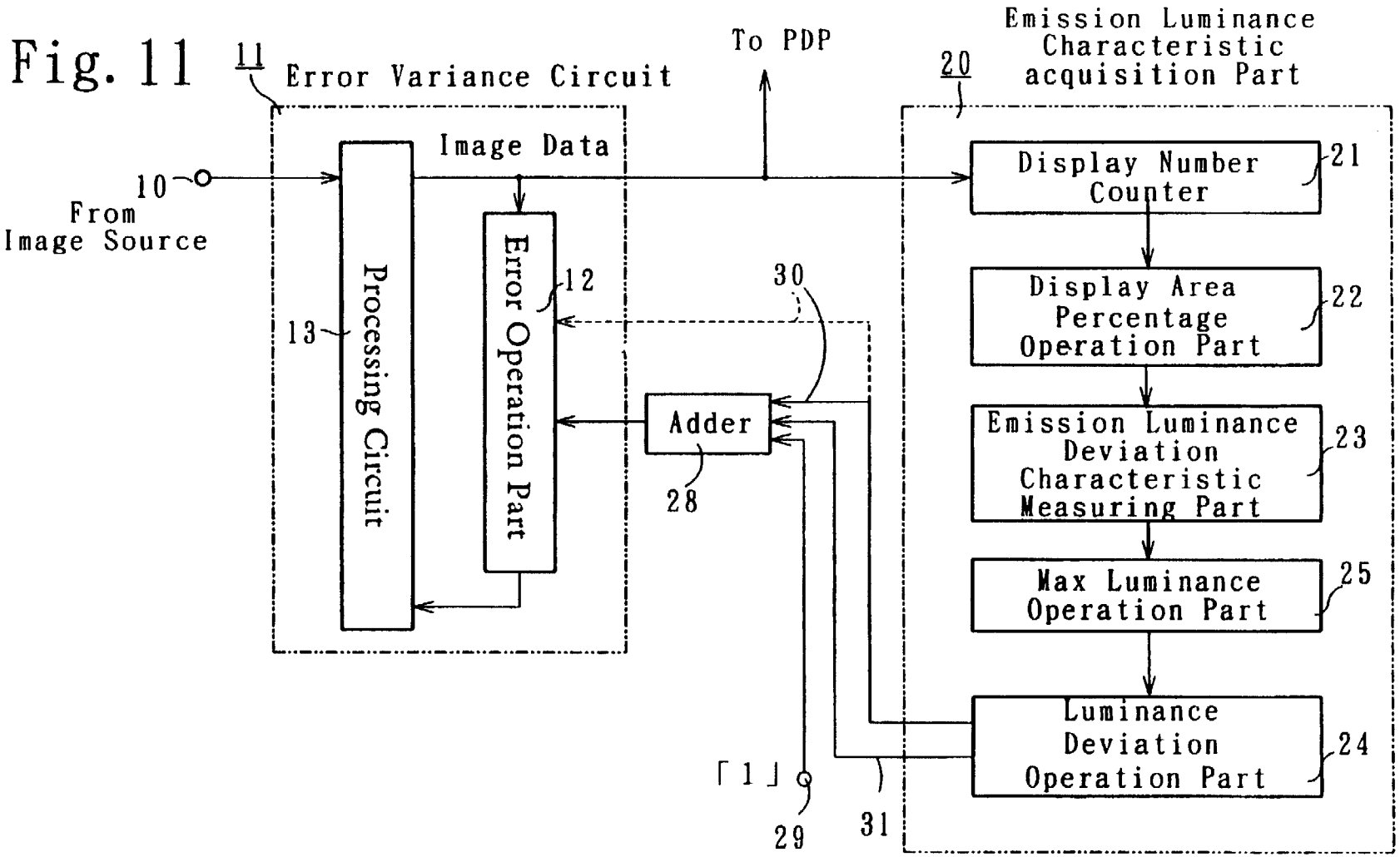
FIG. 11 is a block diagram that shows up the fourth embodiment of the error variance processing equipment for display device according to this invention.

Fourth Embodiment:

Referring now to FIG. 11, the error variance processor in the equipment by this invention consists of the error variance circuit 11 and the emission luminance characteristic acquisition circuit 20.

The emission luminance characteristic acquisition circuit 20, which comprises the display number counter 21, the display area percentage operation part 22, the emission luminance deviation characteristic measuring part 23, and the luminance deviation operation part 24, is intended to acquire, from the image data driven by the PDP, the emission luminance characteristic for every single or plural frames and to transfer the characteristic thus obtained to the error variance circuit 11 all while the image undergoes the vertical synchronization. More particularly in this fourth embodiment the adder 28 is inserted between the luminance deviation operation part 24 and the error operation part 12, by which the emission luminance levels of the luminance deviation operation part 24 can be set uniformly higher to rather darker image for reducing the noise in particular at low level.

More in detail, the display number counter 21, the display area percentage operation part 22, the emission luminance deviation characteristic measuring part 23 are respectively the same as those in their first embodiment (FIG. 5). The luminance deviation operation part 24, which solve for the emission luminance deviation at each level and renews the tonal characteristic of the data at levels other than the low level for every single or plural frames, is the same as that in the third embodiment (FIG. 9).

The adder 28 adds indiscriminately a constant value (1 for instance) as input at input terminal 29 to the output of the high level line 30 to low level line 31 of the luminance deviation operation part 24.

Otherwise the high-level line 30 may be connected directly with the error operation part 12 as shown by the doted line so that a constant value (1 for instance) input at the input terminal 29 may be added to the low level line 31 only by the adder 28.

Explained now will be the actions of the configuration as above.

The luminance deviation at each level of the emission luminance characteristic acquisition circuit 20 is renewed for every single or plural frames, added a constant value at the adder 28 to be transferred to the error variance circuit 11.

Figure 4:
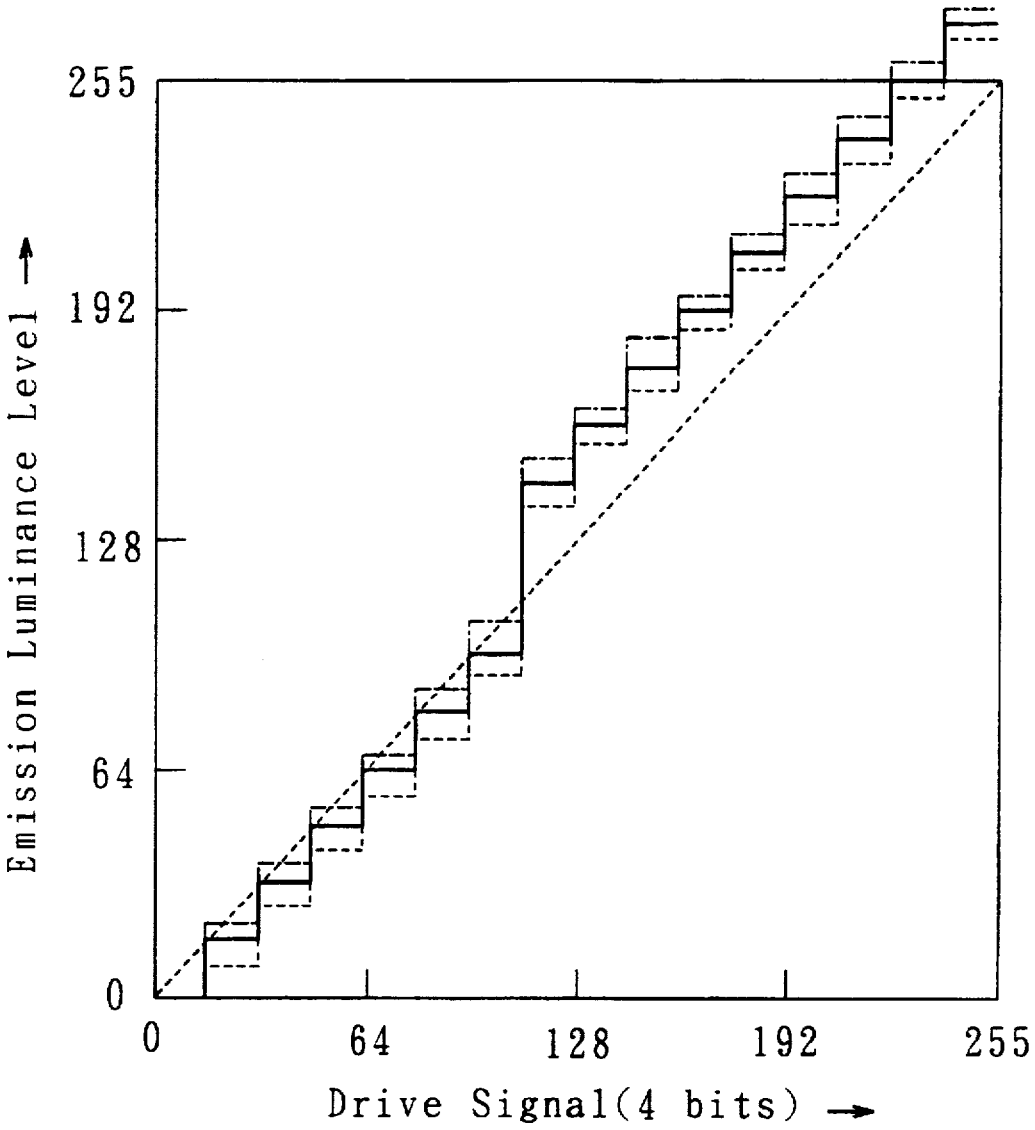
FIG. 4 is still another characteristic diagram that illustrates another example of emission luminance characteristic.

Because the error of the error variance may be expressed by error=input level−emission luminance, a uniform addition, by the adder 28, of a constant value over the high-level line 30 to the low level line 31, will intensify the emission luminance as a whole as shown by the chain line in FIG. 4, and the error lessens all the more. Since, in this case, the addition ratio at the low level is large enough, though the added value is constant from low to high levels, the effect of the noise reduction is greater at low level that at high level.

Nearly the same noise reduction effect can be had even if a constant value is added only to the low level line 31.

The calculation of the emission luminance into the rather higher value and the error into rather lower value will thus darken more or less the image after the error variance rendering the image more natural by the diffusion reduction effect at the low level image.

The error variance circuit 11 processes the error variance based upon the emission luminance deviation by the data renewed moment by moment by the luminance deviation operation part 24, to which a constant value is further added to output the error into the PDP.

Since the convergence into representative emission luminance characteristic is thus avoided by this configuration, the error variance can adapt itself well to the tonal characteristic of any data which may change moment by moment contribute to the prevention of the noise at low level.

The fourth embodiment by this invention has the following actions and effects.

Because the emission luminance characteristics for every single or plural frames are calculated out on the basis of the luminance deviation characteristic as obtained from the load factor of input data, and that the error variance is performed renewing the emission luminance characteristics for every single or plural frames, the false contour can be kept from appearing.

At the same time, a calculation of the emission luminance into rather high value and the error into rather smaller value makes the image after the error variance darker thereby affording an effect of reducing the diffusion noise in particular at the low level image, which will become more natural.

What is claimed is:

1. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part having a ROM providing a luminance deviation characteristic of each bit, and a luminance deviation operation part for providing a luminance deviation from the data of said emission luminance deviation characteristic measuring part.

2. The error variance processing apparatus according to claim 1, wherein the error variance circuit comprises an error operation part and a processing part for performing error variance based on an emission luminance characteristic provided by the luminance deviation operation part, said emission luminance characteristic is used to display the false half tone.

3. The error variance processing apparatus according to claim 1, wherein the error variance circuit outputs the image signal with original pixels as quantized in p number bits changed to q number bits where q is less than p.

4. The error variance processing apparatus according to claim 1, wherein the emission luminance characteristic acquisition circuit calculates an emission luminance level Yn at a given input level n by $$Yn = \sum_{k=0}^{k=M-1} b_k \times 2^k \times (\alpha + \delta(Sk))$$

with M being a number of subfields, α is a referential emission luminance level, δ is a luminance deviation characteristic, and Sk is the display area percentage; and the luminance deviation at each level is calculated by $$\Delta n = \sum_{k=0}^{k=M-1} b_k \times 2^k \times \delta(sk).$$

5. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part, having a ROM, providing a luminance deviation characteristic of each bit, a maximum luminance operation part for calculating the luminance at a maximum input level, and a luminance deviation operation part for providing a luminance deviation of each input level that is calculated based on the data from the maximum luminance operation part.

6. The error variance processing apparatus according to claim 5, wherein the maximum luminance operation part calculates luminance at a maximum input level by $$Ymax = \sum_{k=0}^{k=M-1} 2^k \times (\alpha + \delta(Sk))$$

where $max=2^M-1$ with M being a number of subfields, α is a referential emission luminance level, δ is a luminance deviation characteristic, and Sk is the display area percentage; and the luminance deviation at each level is calculated by $$\Delta n = Yn - \frac{n}{2^M} Ymax.$$

7. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part having a ROM providing a luminance deviation characteristic of each bit, a luminance deviation operation part for providing at the error variance circuit a luminance deviation at a level other than a low level that is calculated based on the data from the emission luminance deviation characteristic measuring part, and a fixed constant generating part outputting a fixed constant as a preset level instead of the low level luminance deviation excluded from said luminance deviation operation part.

8. The error variance processing apparatus according to claim 7, wherein the error variance circuit comprises an error operation part and a processing part for performing error variance based on an emission luminance characteristic provided by the luminance deviation operation part and the fixed constant generating part, said emission luminance characteristic is used to display the false half tone.

9. The error variance processing apparatus according to claim 7, wherein the error variance circuit outputs the image signal with original pixels as quantized in p number bits changed to q number bits where q is less than p.

10. The error variance processing apparatus according to claim 7, wherein the emission luminance characteristic acquisition circuit calculates an emission luminance level Yn at a given input level n by $$Yn = \sum_{k=0}^{k=M-1} b_k \times 2^k \times (\alpha + \delta(Sk))$$

with M being a number of subfields, α is a referential emission luminance level, δ is a luminance deviation characteristic, and Sk is the display area percentage; and the luminance deviation at each level is calculated by $$\Delta n = \sum_{k=0}^{k=M-1} b_k \times 2^k \times \delta(sk).$$

11. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part, having a ROM, providing a luminance deviation characteristic of each bit, a maximum luminance operation part for calculating the luminance at a maximum input level, a luminance deviation operation part for outputting, at the error variance circuit, a luminance deviation at levels other than a low level calculated based on the data from the emission luminance deviation characteristic measuring part, and a fixed constant generating part outputting a fixed constant as a preset level instead of the low level luminance deviation excluded from said luminance deviation operation part.

12. The error variance processing apparatus according to claim 11, wherein the maximum luminance operation part calculates luminance at a maximum input level by $$Ymax = \sum_{k=0}^{k=M-1} 2^k \times (\alpha + \delta(Sk))$$

where max=$2^M-1$ with M being a number of subfields, α is a referential emission luminance level, δ is a luminance deviation characteristic, and Sk is the display area percentage; and the luminance deviation at each level is calculated by $$\Delta n = Yn - \frac{n}{2^M} Ymax.$$

13. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part, having a ROM, providing a luminance deviation characteristic of each bit, a luminance deviation operation part for providing a luminance deviation, and an adder outputting a level of emission luminance higher than the actual level of emission luminance by adding a predetermined value to the luminance deviation obtained at the luminance deviation operation part.

14. The error variance processing equipment according to claim 13, wherein the adder adds a predetermined value to any display level.

15. The error variance processing equipment according to claim 13, wherein the adder adds a predetermined value only to a low level display.

16. The error variance processing apparatus according to claim 13, wherein the emission luminance characteristic acquisition circuit calculates an emission luminance level Yn at a given input level n by $$Yn = \sum_{k=0}^{k=M-1} b_k \times 2^k \times (\alpha + \delta(Sk))$$

with M being a number of subfields, α is a referential emission luminance level, δ is a luminance deviation characteristic, and Sk is the display area percentage; and the luminance deviation at each level is calculated by $$\Delta n = \sum_{k=0}^{k=M-1} b_k \times 2^k \times \delta(sk).$$

17. An error variance processing apparatus for a display device that displays a false half tone via a diffusion output signal provided by an error variance circuit which adds a reproduced error to an input image signal, original pixels of the input image signal being quantizedly input to the error variance circuit, comprising:

an emission luminance characteristic acquisition circuit linked with the error variance circuit, said emission luminance characteristic acquisition circuit including a display number counter circuit having M number counters for counting a display dot number, in singular or plural frames, of each bit of image data having M number bits, said M number counters corresponding respectively to the M number bits, a display area percentage operation part providing a display area percentage by dividing the display dot number counted by the display number counter circuit by total dot number, an emission luminance deviation characteristic measuring part, having a ROM, providing a luminance deviation characteristic of each bit, a maximum luminance operation part for calculating the luminance at a maximum input level, a luminance deviation operation part for providing a luminance deviation from the data collected from the maximum luminance operation part, and an adder outputting a level of emission luminance higher than the actual level of emission luminance by adding a predetermined value to the luminance deviation obtained at the luminance deviation operation part.

18. The error variance processing apparatus according to claim 17, wherein the maximum luminance operation part calculates luminance at a maximum input level by $$Ymax = \sum_{k=0}^{k=M-1} 2^k \times (\alpha + \delta(Sk))$$

where $max=2^M-1$ with M being a number of subfields, $\alpha$ is a referential emission luminance level, $\delta$ is a luminance deviation characteristic, and Sk is the display area percentage; and the luminance deviation at each level is calculated by $$\Delta n = Yn - \frac{n}{2^M} Ymax.$$

* * * * *